US012729639B2

(12) United States Patent
Attard et al.

(10) Patent No.: US 12,729,639 B2
(45) Date of Patent: Sep. 8, 2026

(54) SYSTEM AND METHOD FOR CONTROLLING A COLD LIGHT OFF CATALYST

(71) Applicant: FCA US LLC, Auburn Hills, MI (US)

(72) Inventors: William P Attard, Auburn Hills, MI (US); Jeongyong Choi, Auburn Hills, MI (US); Michael Barkey, Auburn Hills, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 19/066,781

(22) Filed: Feb. 28, 2025

(65) Prior Publication Data

US 2026/0258742 A1 Sep. 3, 2026

(51) Int. Cl.

| | |
|---|---|
| ***F01N 3/20*** | (2006.01) |
| ***F01N 3/023*** | (2006.01) |
| ***F01N 3/08*** | (2006.01) |
| ***F01N 3/28*** | (2006.01) |
| ***F01N 13/08*** | (2010.01) |

(52) U.S. Cl.

CPC ..... *F01N 3/2053* (2013.01); *F01N 3/28* (2013.01); *F01N 3/0234* (2013.01); *F01N 3/0878* (2013.01); *F01N 13/087* (2013.01); *F01N 2410/02* (2013.01); *F01N 2410/06* (2013.01); *F01N 2550/06* (2013.01); *F01N 2550/10* (2013.01)

(58) Field of Classification Search

CPC combination set(s) only.

See application file for complete search history.

(56) References Cited

U.S. PATENT DOCUMENTS

| | | | | |
|---|---|---|---|---|
| 5,603,216 | A * | 2/1997 | Guile | F01N 3/0835 60/288 |
| 12,221,919 | B1 * | 2/2025 | Choi | F02B 37/18 |
| 2001/0011455 | A1 * | 8/2001 | Harima | F01N 3/0842 60/288 |
| 2004/0144084 | A1 * | 7/2004 | Hara | F02D 41/029 60/288 |
| 2006/0213187 | A1 * | 9/2006 | Kupe | F01N 3/035 60/286 |
| 2007/0272480 | A1 * | 11/2007 | Kuroda | F01N 13/0093 181/254 |
| 2008/0295499 | A1 * | 12/2008 | Driscoll | F01N 3/0231 60/287 |

(Continued)

*Primary Examiner* — Binh Q Tran

(74) *Attorney, Agent, or Firm* — Jeremy J. Klobucar

(57) ABSTRACT

A control system for a vehicle powertrain having a normally aspirated engine includes an advanced device, a main catalyst, a cold light off catalyst (CLOC), a CLOC valve and a controller. The advanced device is positioned in an exhaust of the normally aspirated engine. The main catalyst positioned in the exhaust downstream of the advanced device. The CLOC is positioned in a bypass passage around the advanced device. The CLOC valve selectively routes exhaust flow from the normally aspirated engine between advanced device and the CLOC. The controller is configured to: determine a temperature of a main catalyst; determine, based on a temperature of the main catalyst being less than a temperature threshold, a first engine torque request; and command, based on the first engine torque request being less than a first torque threshold, the CLOC valve to operate in a CLOC mode.

14 Claims, 2 Drawing Sheets

(56) References Cited

U.S. PATENT DOCUMENTS

2012/0090295 A1* 4/2012 Yacoub ..... F01N 3/2066
60/303
2018/0156142 A1* 6/2018 Uhrich ..... F02D 41/26

* cited by examiner

SYSTEM AND METHOD FOR CONTROLLING A COLD LIGHT OFF CATALYST

FIELD

The present application relates to vehicle emission systems and, more particularly, to techniques for controlling a valve that directs exhaust flow around an advanced device and into a cold light off catalyst.

BACKGROUND

As is known, pollutant emissions such as nitrogen oxides (NOx), carbon monoxide (CO), and hydrocarbon (HC) are temperature sensitive in aftertreatment systems. Such emission conversion begins at high temperatures such as over 350° C. depending on catalyst formulation. Typically, at engine startup, idle exhaust temperatures are much below the high temperatures needed for optimal catalyst efficiencies. An amount of time is needed for the exhaust to heat up from the typical exhaust temperatures to the elevated temperatures that satisfy a desired efficiency target. Operation of the engine during this heating up time is inefficient for conversion of such pollutants. Accordingly, a need exists in the art to improve upon efficiencies of aftertreatment systems.

SUMMARY

According to one example aspect of the invention, a control system for a vehicle powertrain having a normally aspirated engine includes an advanced device, a main catalyst, a cold light off catalyst (CLOC), a CLOC valve and a controller. The advanced device is positioned in an exhaust of the normally aspirated engine. The main catalyst positioned in the exhaust downstream of the advanced device. The CLOC is positioned in a bypass passage around the advanced device. The CLOC valve selectively routes exhaust flow from the normally aspirated engine between advanced device and the CLOC. The controller is configured to: determine a temperature of a main catalyst; determine, based on a temperature of the main catalyst being less than a temperature threshold, a first engine torque request; and command, based on the first engine torque request being less than a first torque threshold, the CLOC valve to operate in a CLOC mode.

In some implementations, the controller is further configured to: operate the CLOC valve in a normal mode based on a temperature of the main catalyst not being less than a temperature threshold, the normal mode corresponding to routing exhaust gas through the advanced device and to the main catalyst.

In other implementations, the controller is further configured to: determine, based on the first engine torque request not being less than a first torque threshold, whether the torque request is greater than a second torque threshold; and command, based on the torque request being greater than the second torque threshold, the CLOC valve to operate in the normal mode.

In additional implementations, the controller is further configured to: operate, based on the power request not being greater than the second torque threshold, the CLOC valve in a partial CLOC mode.

In some implementations, the advanced device comprises a waste heat recovery system.

In some implementations, the waste heat recovery system includes a Rankine cycle waste heat recovery system.

In other implementations, the advanced device comprises an advanced boosting system.

In additional implementations, the advanced device comprises a thermal recovery system.

In additional implementations, the first torque threshold is indicative of a throttle input of less than 25% of a maximum torque request According to another example aspect of the present invention, a method of controlling a vehicle powertrain having a normally aspirated engine is provided. The powertrain includes an advanced device positioned in an exhaust of the normally aspirated engine, a main catalyst positioned in the exhaust downstream of the advanced device, a cold light off catalyst (CLOC) positioned in a bypass passage around the advanced device, a CLOC valve that selectively routes exhaust flow from the normally aspirated engine between advanced device and the CLOC, and a controller. The method comprises: determining a temperature of a main catalyst; determining, based on a temperature of the main catalyst being less than a temperature threshold, a first engine torque request; and commanding, based on the first engine torque request being less than a first torque threshold, the CLOC valve to operate in a CLOC mode.

In other implementations, the method further includes operating the CLOC valve in a normal mode based on a temperature of the main catalyst not being less than a temperature threshold, the normal mode corresponding to routing exhaust gas through the advanced device and to the main catalyst.

In additional implementations, the method further includes: determining, based on the first engine torque request not being less than a first torque threshold, whether the torque request is greater than a second torque threshold; and commanding, based on the torque request being greater than the second torque threshold, the CLOC valve to operate in the normal mode.

In additional implementations, the method further includes operating, based on the power request not being greater than the second torque threshold, the CLOC valve in a partial CLOC mode.

In additional implementations of the method, the advanced device comprises a waste heat recovery system.

In additional implementations of the method, the waste heat recovery system includes a Rankine cycle waste heat recovery system.

In additional implementations of the method, the advanced device comprises an advanced boosting system.

In additional implementations of the method, the advanced device comprises a thermal recovery system.

In additional examples of the method, the first torque threshold is indicative of a throttle input of less than 25% of a maximum torque request.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

The present disclosure is directed toward emission control on normally aspirated gasoline engines. A system and related techniques are described for controlling a cold start light off catalyst (CLOC) where a CLOC valve is controlled to divert exhaust gas from an advanced device and through a small catalyst in a CLOC mode. The advanced device can be a waste heat recovery system such as a Rankine cycle waste heat recovery system, an advanced boosting system, a thermal recovery system or other device that assists in recovering heat in an exhaust system. While these advanced devices improve fuel consumption, they tend to reduce the effectiveness of heating up a main catalyst.

The CLOC can achieve high efficiency quickly to treat the exhaust gas, while a much larger downstream catalyst is warming up. Control techniques disclosed herein provide methods for controlling the CLOC valve of the CLOC not only based on temperature of the main catalyst, but also based on a power (e.g., torque) request from the driver. As used herein, a power request is indicative of a torque request by the driver. In examples, the torque request can be provided at the inputs such as from an accelerator pedal.

Figure 1:
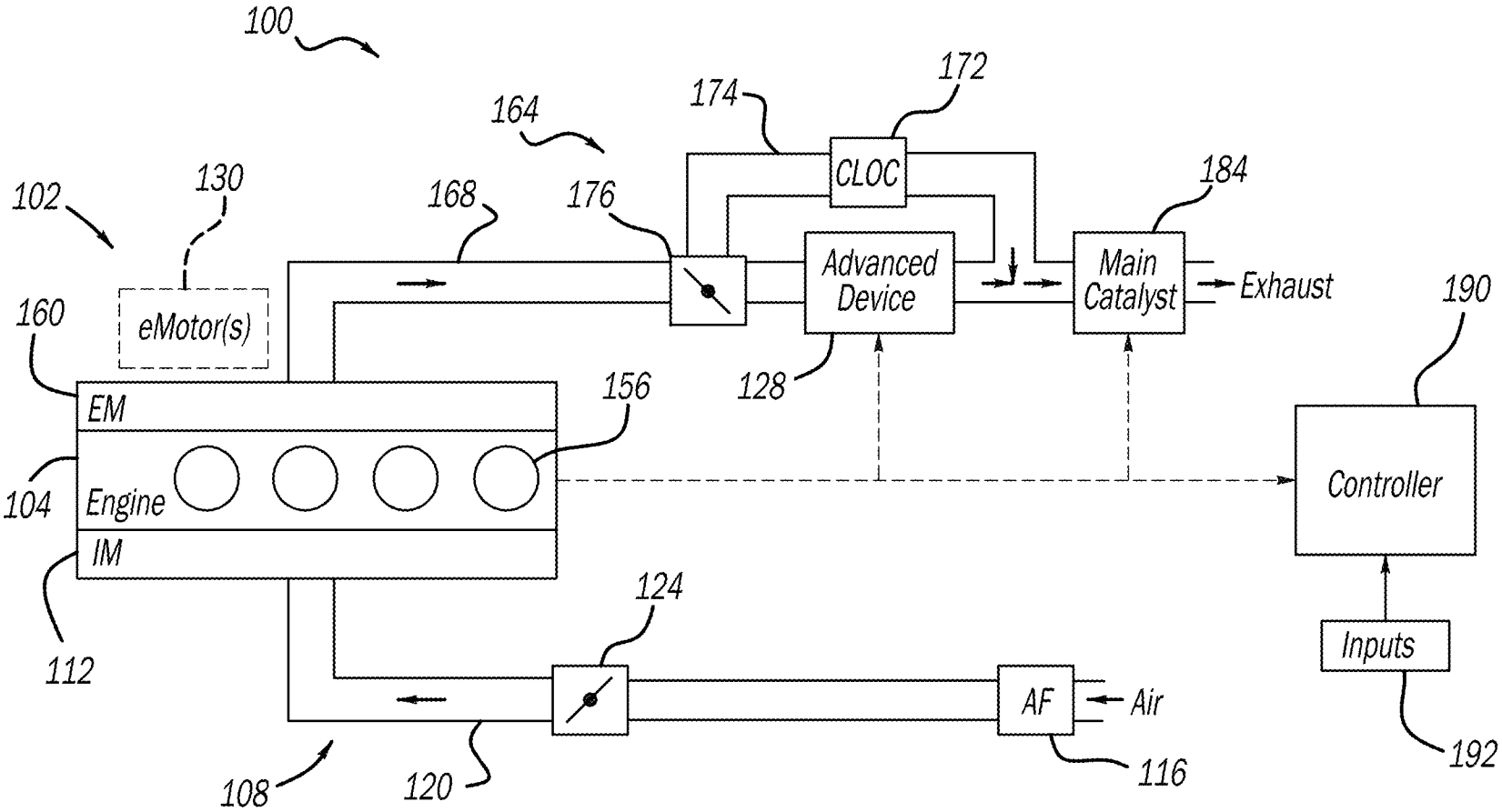
FIG. 1 is a diagram of an example vehicle comprising an engine having an advanced device and further incorporating a cold light off catalyst (CLOC) and CLOC valve according to the principles of the present disclosure.

Referring now to FIG. 1, a diagram of an example vehicle or vehicle control system 100 is illustrated. The vehicle 100 includes a powertrain 102 having an engine 104 configured to combust an air/fuel mixture to generate drive torque. In the example shown, the engine 104 is a normally aspirated engine. The engine 104 includes an intake system 108 that draws fresh air into an intake manifold (IM) 112 through an air filter (AF) 116 and an induction passage 120. A throttle valve 124 regulates a flow of air through the induction passage 120. In additional examples, the powertrain 102 can additionally include one or more electric drive units or motors 130 that provide a torque output. In this regard, the vehicle 100 can be configured as a hybrid vehicle that uses both a normally aspirated engine 104 and one or more electric motors to provide a torque output for propelling the vehicle 100.

The intake air is distributed to a plurality of cylinders 156 and combined with fuel (e.g., from respective direct-injection or port-injection fuel injectors) to form an air/fuel mixture. While four cylinders are shown, it will be appreciated that the engine 104 could include any number of cylinders. The air/fuel mixture is compressed by pistons (not shown) within the cylinders 156 and combusted (e.g., via spark from respective spark plugs) to drive the pistons, which turn a crankshaft (not shown) to generate drive torque. The drive torque is then transferred to a driveline (not shown) of the vehicle 100, e.g., via a transmission (not shown). Exhaust gas resulting from combustion is expelled from the cylinders 156 and into an exhaust manifold (EM) 160 of the engine 104.

The exhaust gas from the exhaust manifold 160 is provided to an exhaust system 164 comprising an exhaust passage 168. The exhaust air is directed toward an advanced device 128. As noted above, the advanced device can be any device suitable to improve fuel economy such as, but not limited to a Rankine cycle waste heat recovery system, an advanced boosting system, a thermal recovery system or other device. It will be appreciated that while the following discussion is focused on a vehicle 100 that incorporates an advanced device 128, the vehicle 100 can be configured without the advanced device 128 while still implementing the control advantages discussed herein.

A cold light off catalyst (CLOC) 172 is routed in a bypass passage 174 around the advanced device. A CLOC valve 176 selectively controls exhaust flow into the advanced device 128 and/or into the CLOC 172 via the bypass passage 174. Explained further, the CLOC valve 176 moves between a fully closed position whereby all exhaust gas is routed to the CLOC 172, a fully open position where all exhaust gas is routed to the advanced device 128 and infinite positions therebetween causing a blend of exhaust to be routed to both of the advanced device 128 and the CLOC 172.

As used herein a "CLOC mode" is used to refer to the controller 190 commanding the CLOC valve 176 to rout at least some exhaust to the CLOC 172. A "partial CLOC mode" is used to denote that the CLOC valve 176 is at some intermediate position wherein some exhaust is routed to the CLOC 172 and some of the exhaust is routed to the advanced device 128. A main exhaust gas treatment system 184, such as a catalytic converter, treats exhaust gas to decrease or eliminate emissions before it is released into the atmosphere. All exhaust gas regardless of passing through the advanced device 128 or the CLOC 172 is directed to the main exhaust gas treatment system 184. The CLOC 172 includes a small catalyst that can reach high efficiency quickly and treat the exhaust gas such as when the main catalyst 184 has yet to reach optimal operating temperature.

A controller, also referred to herein as an engine controller, 190 controls operation of the vehicle 100. Examples of components controlled by the controller 190 include the engine 104, the throttle valve 124, the advanced device 128 and the CLOC valve 176. It will be appreciated that the controller 190 controls specific components of the vehicle 100 that are not illustrated, such as, but not limited to, fuel injectors, spark plugs, an EGR valve, a VVC system (e.g., intake/exhaust valve lift/actuation), a transmission, and the like.

The controller 190 controls operation of these various components based on measured and/or modeled parameters. Inputs 192 such as one or more sensors are configured to measure one or more parameters, and communicate signals indicative thereof to the controller 190 (pressures, temperatures, speeds, etc.) as discussed in greater detail herein. Other parameters could be modeled by the controller 190, e.g., based on other measured parameters. The controller 190 is also configured to perform the engine control techniques.

Figure 2:
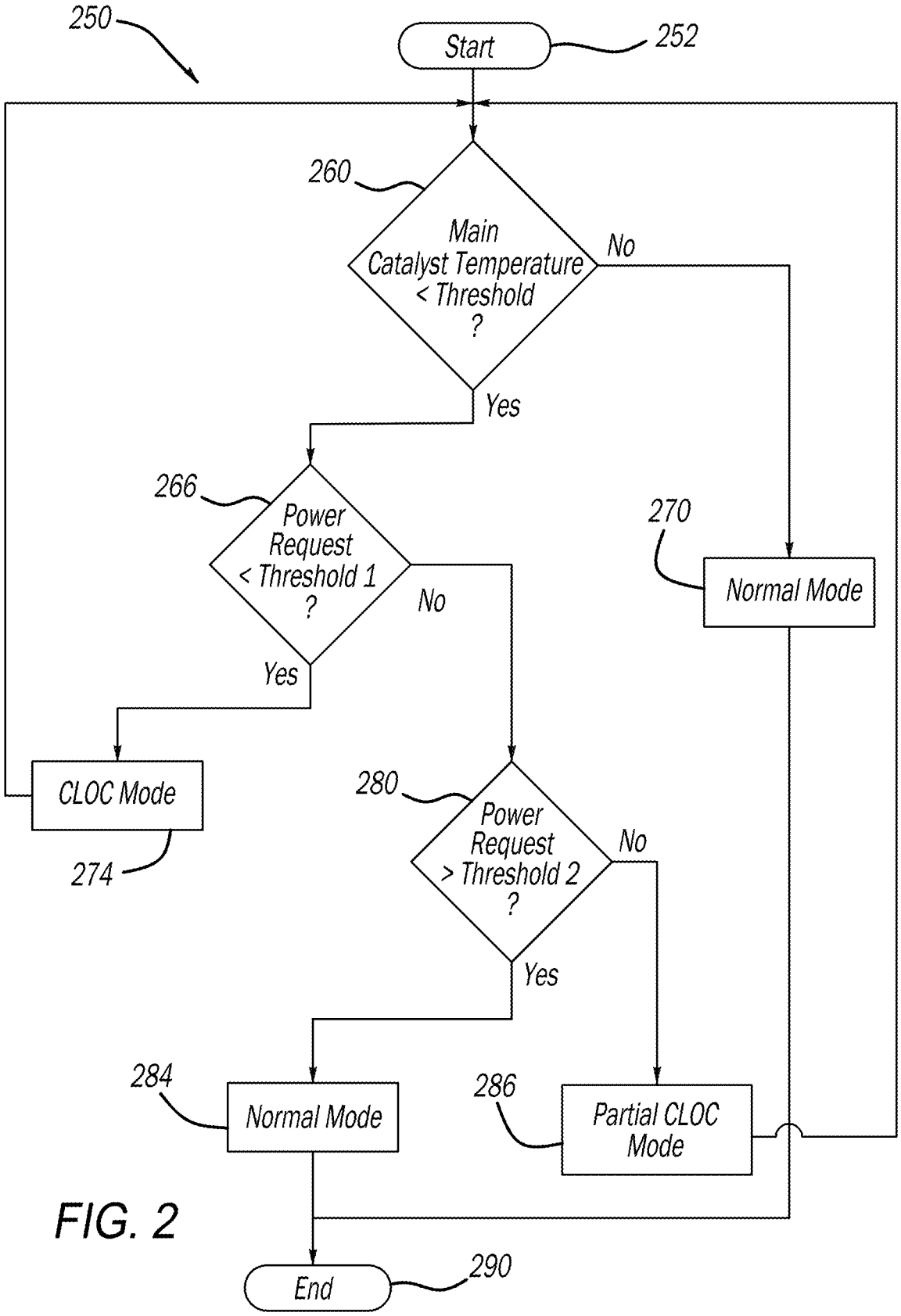
FIG. 2 is a flow diagram of an example control method of operating the CLOC valve of the CLOC according to examples of the present disclosure.

Referring now to FIG. 2, a flow chart of an example method 250 of operating the engine 104 having the advanced device 128, CLOC 172 and CLOC valve 176 is illustrated. For explanatory purposes, components of the vehicle 100 will be referenced, but it will be appreciated that this method 250 could be used for any engine having an advanced device and a CLOC. Control starts at 252. At 260, the controller 190 determines whether the temperature of the main catalyst 184 is less than a threshold. In examples, the controller 190 can receive a temperature signal from the inputs 192 indicative of a main catalyst 184. In other examples, the controller 190 can estimate the temperature of the main catalyst 184 based on a collection of input measurements (ambient temperature, time since last engine on event, time since engine start, etc.). If the controller 190 determines that the temperature of the main catalyst 184 is less than a threshold, control determines whether a power request is less than a first threshold at 266. In examples, the first threshold can be a throttle input of between 0% and 25% a maximum torque request. The first threshold can have different ranges and can be predetermined based on various calibrations and/or a configuration of the powertrain 102.

As used herein, a power request is indicative of a torque request by the driver. In examples, the torque request can be provided at the inputs 192 such as from an accelerator pedal. If the controller 190 determines that the temperature of the main catalyst 184 is not less than a threshold, control operates the exhaust system 164 in a normal mode at 270 and control ends at 290. A normal mode can be defined as routing the exhaust gas to the main catalyst 184 without directing the exhaust gas to the CLOC 172 through the bypass passage 174.

If control determines that the power request is less than a first threshold at 266, control operates the exhaust system 164 in CLOC mode at 274. If control determines that the power request is not less than a first threshold at 266, control determines whether a power request is greater than a second threshold at 280. In examples, the second threshold can be a throttle input of between 50% and 100% a maximum torque request. The second threshold can have different ranges and can be predetermined based on various calibrations and/or a configuration of the powertrain 102.

If control determines that the power request is greater than the second threshold at 280, control operates the exhaust system 164 in normal mode at 284 and control ends at 286. If control determines that the power request is not greater than the second threshold at 280, control operates the exhaust system 164 in partial CLOC mode at 290.

It will be appreciated that the term "controller" as used herein refers to any suitable control device or set of multiple control devices that is/are configured to perform at least a portion of the techniques of the present disclosure. Non-limiting examples include an application-specific integrated circuit (ASIC), one or more processors and a non-transitory memory having instructions stored thereon that, when executed by the one or more processors, cause the controller to perform a set of operations corresponding to at least a portion of the techniques of the present disclosure. The one or more processors could be either a single processor or two or more processors operating in a parallel or distributed architecture.

It should be understood that the mixing and matching of features, elements, methodologies and/or functions between various examples may be expressly contemplated herein so that one skilled in the art would appreciate from the present teachings that features, elements and/or functions of one example may be incorporated into another example as appropriate, unless described otherwise above.

What is claimed is:

1. A control system for a vehicle powertrain having a normally aspirated engine, the system comprising:

an advanced device positioned in an exhaust of the normally aspirated engine;

a main catalyst positioned in the exhaust downstream of the advanced device;

a cold light off catalyst (CLOC) positioned in a bypass passage around the advanced device;

a CLOC valve that selectively routes exhaust flow from the normally aspirated engine between advanced device and the CLOC; and a controller configured to:

determine a temperature of a main catalyst;

determine, based on a temperature of the main catalyst being less than a temperature threshold, a first engine torque request;

command, based on the first engine torque request being less than a first torque threshold, the CLOC valve to operate in a CLOC mode;

operate the CLOC valve in a normal mode based on a temperature of the main catalyst not being less than a temperature threshold, the normal mode corresponding to routing exhaust gas through the advanced device and to the main catalyst;

determine, based on the first engine torque request not being less than a first torque threshold, whether the torque request is greater than a second torque threshold; and command, based on the torque request being greater than the second torque threshold, the CLOC valve to operate in the normal mode.

2. The control system of claim 1, wherein the controller is configured to:

operate, based on the power request not being greater than the second torque threshold, the CLOC valve in a partial CLOC mode.

3. The control system of claim 1, wherein the advanced device comprises a waste heat recovery system.

4. The control system of claim 3, wherein the waste heat recovery system includes a Rankine cycle waste heat recovery system.

5. The control system of claim 1, wherein the advanced device comprises an advanced boosting system.

6. The control system of claim 1, wherein the advanced device comprises a thermal recovery system.

7. The control system of claim 1, wherein the first torque threshold is indicative of a throttle input of less than 25% of a maximum torque request.

8. A method of controlling a vehicle powertrain having a normally aspirated engine, the powertrain having an advanced device positioned in an exhaust of the normally aspirated engine, a main catalyst positioned in the exhaust downstream of the advanced device, a cold light off catalyst (CLOC) positioned in a bypass passage around the advanced device, a CLOC valve that selectively routes exhaust flow from the normally aspirated engine between advanced device and the CLOC, and a controller, the method comprising:

determining a temperature of a main catalyst;

determining, based on a temperature of the main catalyst being less than a temperature threshold, a first engine torque request;

commanding, based on the first engine torque request being less than a first torque threshold, the CLOC valve to operate in a CLOC mode;

operating the CLOC valve in a normal mode based on a temperature of the main catalyst not being less than a temperature threshold, the normal mode corresponding to routing exhaust gas through the advanced device and to the main catalyst determining, based on the first engine torque request not being less than a first torque threshold, whether the torque request is greater than a second torque threshold; and commanding, based on the torque request being greater than the second torque threshold, the CLOC valve to operate in the normal mode.

9. The method of claim 8, further comprising:

operating, based on the power request not being greater than the second torque threshold, the CLOC valve in a partial CLOC mode.

10. The method of claim 8, wherein the advanced device comprises a waste heat recovery system.

11. The method of claim 10, wherein the waste heat recovery system includes a Rankine cycle waste heat recovery system.

12. The method of claim 8, wherein the advanced device comprises an advanced boosting system.

13. The method of claim 8, wherein the advanced device comprises a thermal recovery system.

14. The method of claim 8, wherein the first torque threshold is indicative of a throttle input of less than 25% of a maximum torque request.

* * * * *